US007478766B2

(12) United States Patent
Clarke, III et al.

(10) Patent No.: US 7,478,766 B2
(45) **Date of Patent: *Jan. 20, 2009**

(54) PORTABLE SPRAYER WITH CONNECTOR MOUNTING BEAMS

(75) Inventors: J. Lyell Clarke, III, St. Charles, IL (US); Daniel K. Childs, Chicago, IL (US); Gregory J. Holderfield, Oak Park, IL (US)

(73) Assignee: Clarke Consumer Products, Inc., Roselle, IL (US)

( * ) Notice: Subject to any disclaimer, the term of this patent is extended or adjusted under 35 U.S.C. 154(b) by 247 days.

This patent is subject to a terminal disclaimer.

(21) Appl. No.: 11/170,401

(22) Filed: Jun. 29, 2005

(65) Prior Publication Data

US 2005/0284951 A1 Dec. 29, 2005

Related U.S. Application Data

(63) Continuation-in-part of application No. 10/879,611, filed on Jun. 29, 2004, now Pat. No. 7,178,743.

(51) Int. Cl.
*A62C 31/00* (2006.01)

(52) U.S. Cl. ..... 239/304; 239/77; 239/351; 239/355; 239/398; 239/416.3

(58) Field of Classification Search ..... 239/351, 239/353, 355, 358, 398, 416.3, 77
See application file for complete search history.

(56) References Cited

U.S. PATENT DOCUMENTS

| | | | | |
|---|---|---|---|---|
| 3,793,763 | A | 2/1974 | Griffin et al. | |
| 3,926,369 | A | 12/1975 | Pearce | |
| 3,937,402 | A | 2/1976 | Query | |
| 4,050,629 | A | 9/1977 | Query et al. | |
| 4,116,385 | A * | 9/1978 | Waldron | 239/77 |
| 4,272,019 | A | 6/1981 | Halaby, Jr. | |
| 4,671,435 | A | 6/1987 | Stout et al. | |
| 5,248,448 | A | 9/1993 | Waldron et al. | |
| 5,269,461 | A | 12/1993 | Davis | |
| 5,566,502 | A * | 10/1996 | Shigetoyo | 43/125 |
| 6,032,407 | A * | 3/2000 | Conner | 43/129 |
| 6,152,382 | A * | 11/2000 | Pun | 239/77 |
| 6,164,560 | A | 12/2000 | Lehrke et al. | |
| 6,375,089 | B1 | 4/2002 | Taylor et al. | |
| 6,443,434 | B1 | 9/2002 | Prather | |
| 2001/0050317 | A1 | 12/2001 | Denen | |

(Continued)

*Primary Examiner*—Len Tran
*Assistant Examiner*—Trevor E. McGraw
(74) *Attorney, Agent, or Firm*—Cook Alex Ltd.

(57) ABSTRACT

A portable, battery-powered sprayer for dispensing two liquid products at the same time. A reservoir cartridge having two liquid chambers is removably installable in a reciprocating bay in the housing. First and second mating pairs of fluid connectors each have a component mounted on the cartridge and a component mounted in the housing. A cam on a pivotable lever causes the bay to move the fluid connector components into and out of engagement. The fluid connector components permit fluid flow when they are joined and prevent it when they are separated. A support beam locks the housing components of the fluid connectors in fixed relation to one another. A guide strip locks the cartridge components in the same fixed relation to one another. A docking station in the bay locates the guide strip.

29 Claims, 13 Drawing Sheets

U.S. PATENT DOCUMENTS

2002/0020756 A1 2/2002 Yahav
2002/0030117 A1 3/2002 Bryan et al.
2002/0100819 A1 8/2002 Taylor et al.
2002/0130146 A1 9/2002 Borut et al.
2003/0132311 A1 7/2003 Dorendorf et al.
2003/0160062 A1* 8/2003 Inoue et al. ..... 222/52
2003/0177841 A1 9/2003 Skinner
2003/0192959 A1 10/2003 Hess et al.

* cited by examiner

PORTABLE SPRAYER WITH CONNECTOR MOUNTING BEAMS

CROSS-REFERENCE TO RELATED APPLICATION

This application is a continuation-in-part of application Ser. No. 10/879,611, filed Jun. 29, 2004 now U.S. Pat. No. 7,178,743.

BACKGROUND OF THE INVENTION

This invention relates to a portable sprayer and is particularly concerned with a sprayer for treating an area with two different products in a single pass. The sprayer is particularly adapted for applying mosquito control products, although its use is not limited to this application.

The most effective treatment of an area for mosquito control results from the application of two products. The first product, known as a knockdown product or knockdown treatment, is designed to kill mosquitoes already in a treatment zone. It is most effective when applied as an ultra low volume (ULV) spray or fog with small, lightweight droplet sizes. The second product, known as a barrier product or barrier treatment, is designed to prevent mosquitoes from entering the treatment zone. It is best applied in larger, heavier droplet sizes that impinges on plants and foliage with a material that repels and/or kills mosquitoes. The difference in required droplet sizes for the knockdown product and barrier product dictates that two separate nozzles be used to distribute the two products. This has been done commercially with a variety of units, all having separate sprayers.

Some prior art ULV sprayers of this type are mounted on a truck and are engine-powered. Similarly, truck-mounted mist blowers having very large blasts of air are powered by gasoline engines. With these types of units mounted on trucks there is ample space to accommodate separate nozzles and ample power available to drive them. Such is not the case with sprayers intended for household or consumer use. Other prior art sprayers have ULV nozzles in a hand-held unit powered by a small gasoline engine or an electric motor using a power cord. There are also prior art barrier product sprayers that supply a liquid stream only. That is, there is no air mixed with the liquid. These are available for nursery and household use in both truck-mounted and hand-cart mounted units. They are powered both by gasoline engines and electric motors, including battery powered motors.

Household sprayers need to be portable, preferably hand-held units which do not require an electrical cord. Because of these limitations in portable units, the conventional practice in household sprayers has been to make two separate passes with two separate nozzles, one for applying the knockdown product and one for applying the barrier product. Obviously, this is not the most convenient arrangement since making two passes takes twice as long as making one pass. Also, with this conventional practice either two entirely separate sprayers must be used or a single sprayer must have its nozzle and product supply reservoir changed after the first pass. Neither of these arrangements is optimal.

Furthermore, it is desirable to use battery power for household sprayers because rechargeable batteries are more convenient to use compared to units powered by gasoline engines or household current, the latter requiring a long, unwieldy extension cord. While hand-held, battery-powered sprayers are preferable from a convenience standpoint, the batteries are limited in the amount of power they can supply so the sprayer must be designed to minimize power use and make changing the battery pack simple and quick. It has not previously been feasible to have a dual-output sprayer including a ULV nozzle in a hand-held, battery-powered unit.

SUMMARY OF THE INVENTION

A primary object of the present invention is a portable sprayer having dual output nozzles for applying two separate products at the same time.

Another object of the invention is a sprayer of the type described in which the nozzles produce different droplet sizes.

Yet another object of the invention is a sprayer which is battery powered.

A further object of the invention is a sprayer having dual product chambers with quick connect fluid connectors between the chambers and the fluid lines supplying product to the pump.

Still another object of the invention is a sprayer of the type described which detects a low voltage condition in the batteries and prevents operation of the unit under such conditions.

Another object is a sprayer which aligns first and second pairs of fluid connectors for relative reciprocating movement that connects and disconnects the connectors upon pivotal movement of a lever.

These and other desired benefits of the invention, including combinations of features thereof, will become apparent from the following description. It will be understood, however, that a device could still appropriate the claimed invention without accomplishing each and every one of these desired benefits, including those gleaned from the following description. The appended claims, not these desired benefits, define the subject matter of the invention.

DETAILED DESCRIPTION OF THE INVENTION

Figure 1:
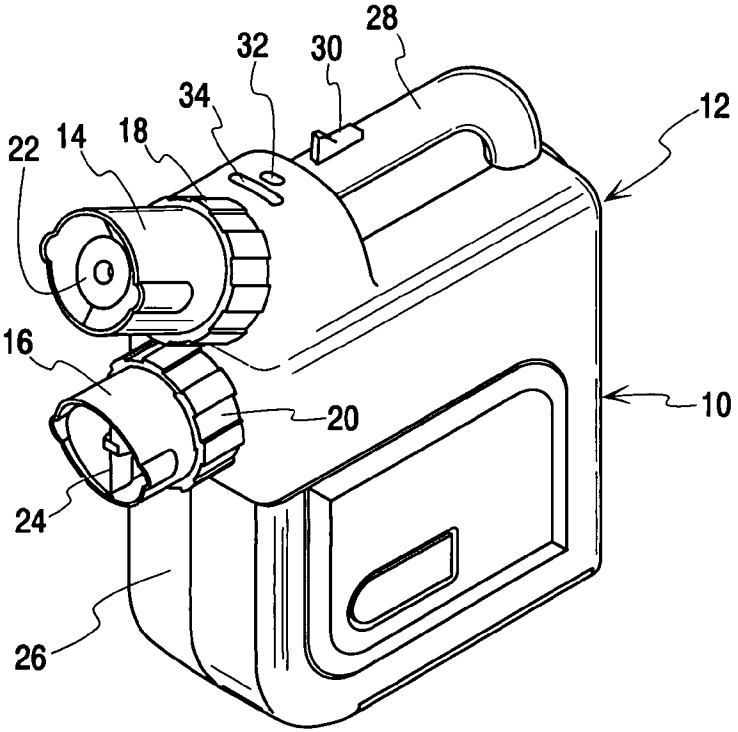
FIG. 1 is a perspective view of the sprayer of the present invention.

The portable sprayer of the present invention is shown generally at 10 in FIG. 1. The sprayer includes a housing 12 in which most of the sprayer components are contained. The most prominent components visible on the exterior of the housing are the shrouds 14, 16 of the first and second spray nozzles. The shrouds protrude from the housing 12. They have a ledge that engages the interior of the housing to keep the shrouds from being pulled out of the housing. Knurled collars 18, 20 engage the shrouds to prevent them from being pushed into the housing. The liquid emitter mounting brackets 22, 24 of the first and second nozzles are partially visible within the shrouds 14, 16. The liquid emitters themselves are described more fully below. Beneath the second nozzle shroud 16 there is a door 26 that provides access to a liquid reservoir compartment. This door may also function as a lever for actuating a reservoir support tray.

Other externally-visible features of the sprayer include a handle 28 and a control switch 30 on the top of the handle. In front of the switch there are a pair of openings or windows 32, 34 through which operational indicators can be viewed. The indicators may be as simple as an LED which shows when the battery is charging. Or the indicators could include a more complicated readout showing the user the battery charge level, the amount of liquid left in the product chambers, or similar information.

Figure 2:
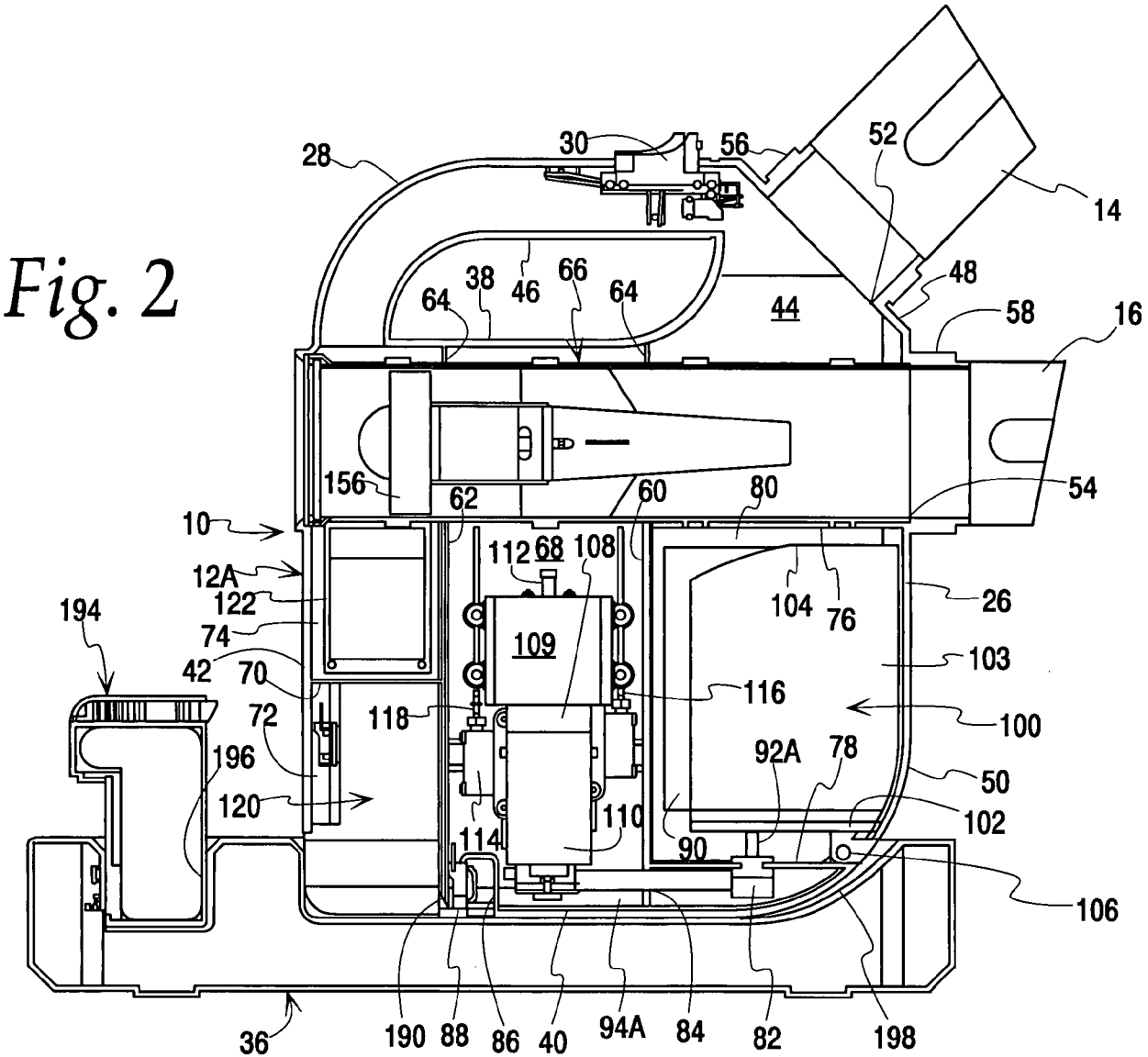
FIG. 2 is a side elevation view of the sprayer and charging cradle assembly, with some parts in section and one half of the housing case removed to expose the interior components.

The housing 12 is split vertically into two case-like halves. FIG. 2 illustrates the sprayer resting in its charging cradle 36 with one housing half removed so the internal components are visible. The housing half 12A includes a top wall 38, a bottom wall 40, a rear wall 42 and a side wall 44. The top wall 38 curves upwardly toward the front of the housing so that together with the handle 28 it defines an opening 46 that receives a user's hand. At its peak the top wall 38 slopes downwardly at an angled wall 48 to meet with the front wall 50. The door 26 forms much of the front wall. It will be noted that the handle 28 is hollow so a wiring harness (not shown) can be run through it to the control switch 30 and the indicators on top of the handle. The front of the housing has a pair of nozzle openings 52 and 54 through which the first and second nozzle 14 and 16 extend.

The housing has a plurality of internal walls or partitions that define various compartments. Front and rear vertical partitions 60, 62 each have a cutout portion 64. The cutouts receive the wind tunnel 66 as will be explained. Beneath the wind tunnel and between the vertical partitions 60, 62 there is a pump compartment 68. A divider wall 70 extends from the rear vertical partition 62 to the rear wall 42. It defines a battery compartment 72 and a control circuit compartment 74. Top and bottom horizontal walls 76, 78 join the front vertical partition 60 and extend to the front of the housing to define the liquid reservoir compartment 80. The bottom wall 78 has an opening that receives a connector support beam 82 for a quick-connect fluid connector. The female mating half of the fluid connector (not shown) is mounted in the bottom of the reservoir cartridge. Just underneath the corner of the bottom wall 78 and front vertical partition 60 are passages (one of which is shown at 84) for the fluid supply lines.

Near the junction of the rear vertical partition 62 and the bottom wall 40 there is an indentation in the bottom wall that forms a charging receptacle 86. Electrical connectors are located here to electrically connect the battery pack to a charging electrode extending upwardly from the cradle 36. At the lower left corner of the charging receptacle the bottom wall has a catch 88. The catch is engageable with a latch on the battery pack to retain the battery pack in the battery compartment 72. In this regard it will be noted that the bottom wall 40 does not extend to meet with the rear wall 42. Instead, the battery pack 120 forms the bottom rear corner of the sprayer unit when it is installed. This construction allows a user to remove and replace the battery pack with just one hand, as will be explained more fully below.

The other housing half is similar. The housing halves may be fastened together with screws or the like. Each housing half will also include a plurality of mounting posts or pads which receive screws for attachment of the various components in their respective compartments.

Figure 3:
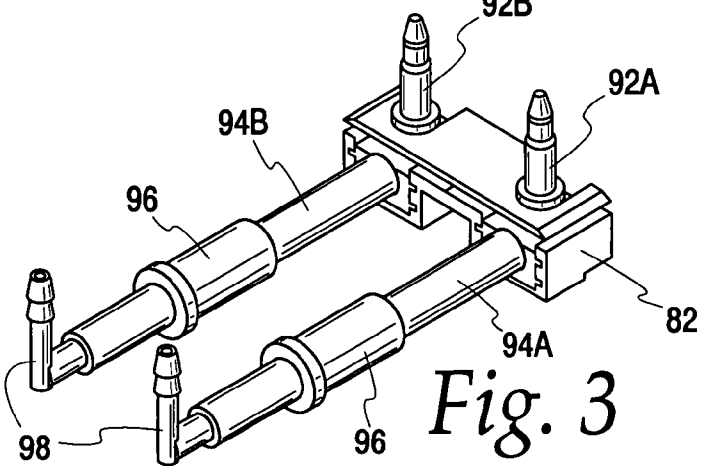
FIG. 3 is a perspective view of the reservoir cartridge connectors and supply lines.

Turning now to the components mounted in the housing, a description of the liquid reservoir cartridge will be given first. The liquid reservoir cartridge itself is partially visible at 90. The reservoir is a replaceable, twin-chamber cartridge or package. Preferably the cartridge has relatively stiff side walls, a top and a floor. Inside the cartridge are two chambers. Preferably each chamber comprises a plastic bag capable of retaining liquid therein. One of the bags will contain the chemistry for the knockdown product and the other bag will contain the chemistry for the barrier product. The floor of the reservoir cartridge has two quick-connect, female connector halves (not shown). There is one female connector for each bag and they are in fluid communication with the interior of each bag. The female connector halves mate with corresponding male quick-connect connectors 92A, 92B (FIG. 3). These connectors are mounted in the support beam 82 which in turn is fixed to the bottom wall 78 in the bottom of the reservoir compartment 80. The quick connectors may be of a type supplied by IPN of Peachtree, Ga. under their trademark Clean Clic Systems®. When the male and female connectors are separated, valves in the connectors prevent liquid flow through the connector halves. As seen in FIG. 3, fluid supply lines 94A, 94B are attached to the male connectors 92A, 92B. The supply lines extend through the openings 84 in the front vertical partition 60. Check valves 96 are included in the supply lines. Filters may also be incorporated in the supply lines. Elbows 98 direct the supply lines to the liquid pump heads as described below.

Inside the reservoir compartment 80 there is a tray 100 that mounts the reservoir cartridge 90. The tray has a floor 102, side walls 103 and a top wall 104. The floor is attached to a cam 106 that is pivoted to the housing walls. The cam is also connected to the front door 26. The door serves as a lever that actuates the cam 106. Opening the door through a clockwise motion (as seen in FIG. 2) about the cam's pivot causes the floor 102 to move upwardly in a linear motion. This linear motion disengages the female fluid connectors of the reservoir cartridge from the compartment's male connectors 92A, 92B. Disengaging the fluid connectors causes them to close and prevent any fluid flow through them. With the connectors disengaged, an empty reservoir cartridge can be removed from the tray 100 and replaced with a full one. Then the door 26 is closed by means of a counterclockwise motion about the cam's pivot. This causes the tray floor 102 to move downwardly. The female fluid connectors of the new, full reservoir cartridge engage the male fluid connectors 92 at the bottom of the reservoir compartment 80 to establish fluid communication between the twin chambers of the new cartridge and the fluid supply lines 94A, 94B. This provides a safe, effective and reliable way to make fluid connections without the user having to handle any of the fluid lines, connectors or the products themselves.

The next major area of the housing is the pump compartment 68. It contains a low-energy air pump 108 which is driven by an air pump motor 110. A bracket 109 mounts the air pump 108 to the housing. The air pump 108 supplies pressurized air to the first nozzle through an air pipe 112. Behind the air pump is a low energy liquid pump 114 which is driven by a liquid pump motor. The liquid pump motor is hidden in FIG. 2 behind the air pump motor 110. The liquid pump 114 is preferably a dual head diaphragm pump. Thus, one motor drives one dual head pump that supplies two separate fluids to two separate nozzles. The heads of the liquid pump are connected to the reservoir cartridge 90 by liquid supply lines 94A, 94B and the elbows 98, as seen in FIG. 3. The pump outlets are connected to nozzle supply lines or tubes. Knockdown spray line 116 connects to the first nozzle and barrier spray line 118 connects to the second nozzle.

The battery compartment 72 contains a battery pack shown generally at 120. Further details of the battery pack are described below. Connectors in the battery pack electrically connect the battery pack to the control circuit 122 which is mounted in the control circuit compartment 74. The control circuit is mounted on a printed circuit board. The printed circuit board has a power supply section that includes connectors for wires that supply electric power to the air pump motor 110 and the liquid pump motor, as well as to the fan motor 158 in the second nozzle. The printed circuit board also connects to the switch 30 in the handle and to the indicator LED's in the handle. A microcontroller is included on the printed circuit board to provide a level of intelligence that, for example, prevents operation when the battery voltage drops to a level that is incapable of producing the proper droplet sizes, when the reservoir cartridge is empty or not installed, or when the sprayer is mounted in the charging cradle. Also, the microcontroller is programmed to turn the air supply motors on before the liquid pump is activated and turn the air supply motors off after the liquid pump is shut down. This assures that liquid never flows without an accompanying air supply and any residual liquid in the emitters is blown out the nozzles and will not remain in the unit after it is turned off.

Figure 4:
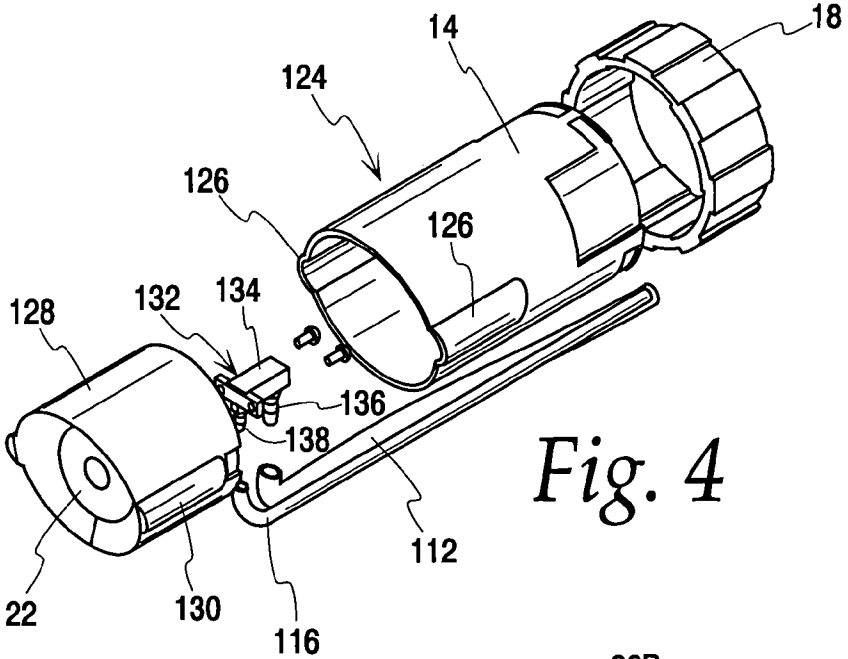
FIG. 4 is an exploded perspective view of the ULV nozzle which dispenses the knockdown product.

The first nozzle for dispensing the knockdown product is shown generally at 124 in FIG. 4. The term nozzle as used herein includes not only a liquid emitter but also a plenum for the air that is mixed with the liquid. The first nozzle is mounted in the upper portion of the housing. The axis of the nozzle is disposed at about a 45° angle to the bottom and top walls of the housing. Obviously when the housing is in its normal orientation wherein the bottom wall is parallel to the ground, then the first nozzle will dispense the knockdown product at about 45° above the ground. The nozzle 124 includes the first shroud 14 which is in the form of a generally cylindrical tube. The shroud 14 fits through the housing opening 52 and is fixed to the housing by the knurled collar 18 and the ledge on the interior of the shroud. A pair of opposed blisters 126 on the outer end of the shroud locate an emitter mounting shell 128. The shell fits telescopically into the shroud. Protrusions 130 engage the blisters 126 to provide an anti-rotation feature. The shell 128 mounts an emitter 132. This is an ultra low volume (ULV) emitter. As seen in FIG. 4, the emitter includes a body 134 with an internal passage. An air inlet 136 connects to the internal passage and the air feeder line 112 coming from the air pump 108. The air pump supplies about 6 liters of air per minute at a pressure of about 7.5 pounds per square inch. A liquid inlet 138 connects to the internal passage and the liquid feeder line 116 coming from one of the heads of the liquid pump 114. The liquid pump supplies about 35 to 40 milliliters of knockdown liquid per minute. The relationship between air and liquid flow is important because if the liquid to air ratio is too high the droplet sizes become too large. Downstream of the air and liquid inlets the emitter passage has a venturi (not shown). The venturi, combined with the effect of the high pressure air, breaks the knockdown liquid into droplets whose average volume median diameter is about 15 to 30 microns. This creates a fog that is ejected from the emitter in a cone-shaped pattern and permeates the surrounding area, resulting in delivery of the insecticide to mosquitoes in the vicinity. The emitter design allows creation of the small droplet sizes with a minimal power requirement. The motors driving the pumps supplying the ULV nozzle of the present invention use much less power than in prior designs. The motors supplying air and liquid to the ULV nozzle draw only about 2 to 3 amps. This is important in a portable sprayer whose only available power supply is a rechargeable battery pack.

Figure 5:
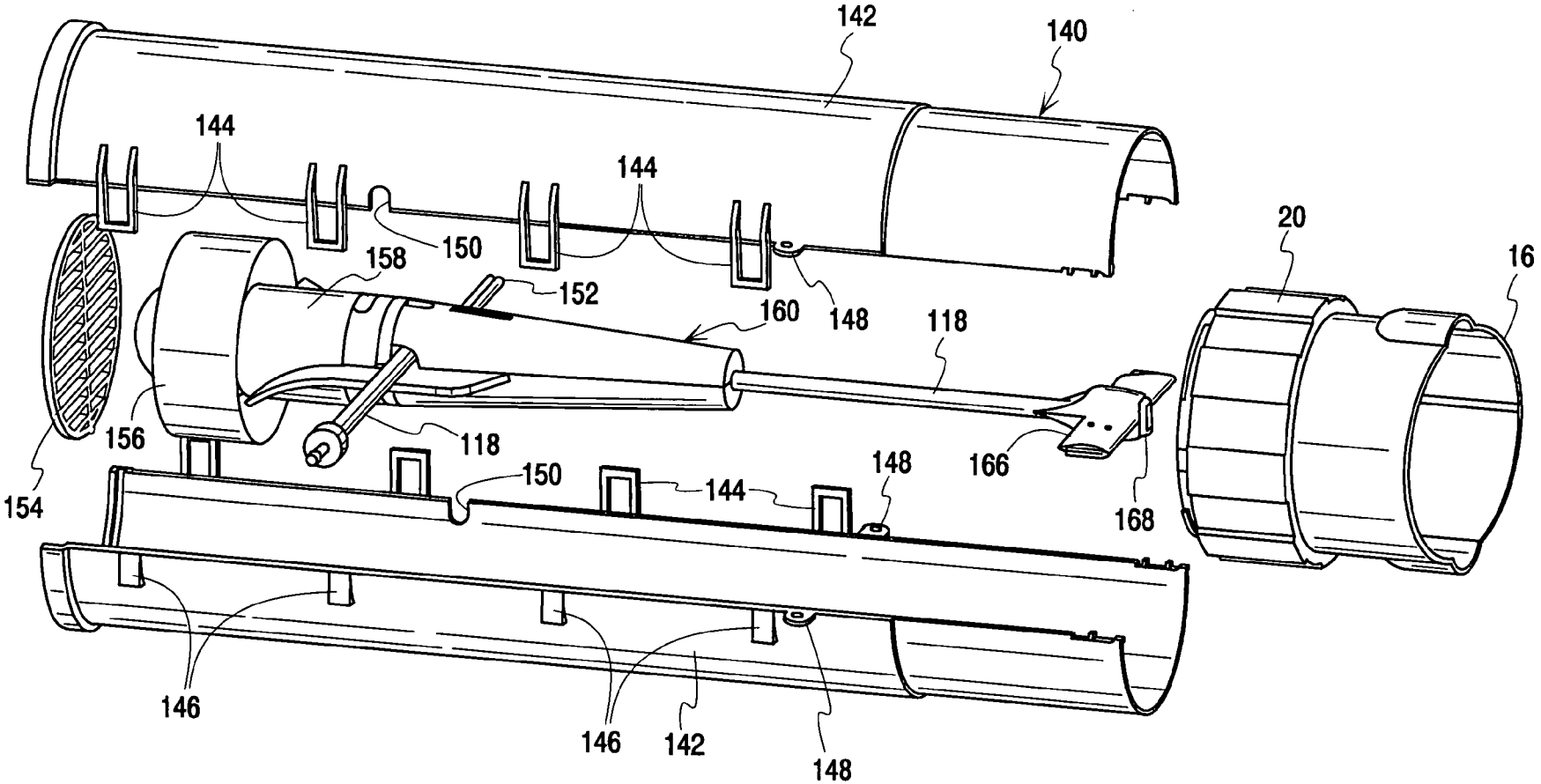
FIG. 5 is an exploded perspective view of the wind tunnel of the barrier dispensing nozzle, shown rotated about its axis 90° from its installed position.
Figure 6:
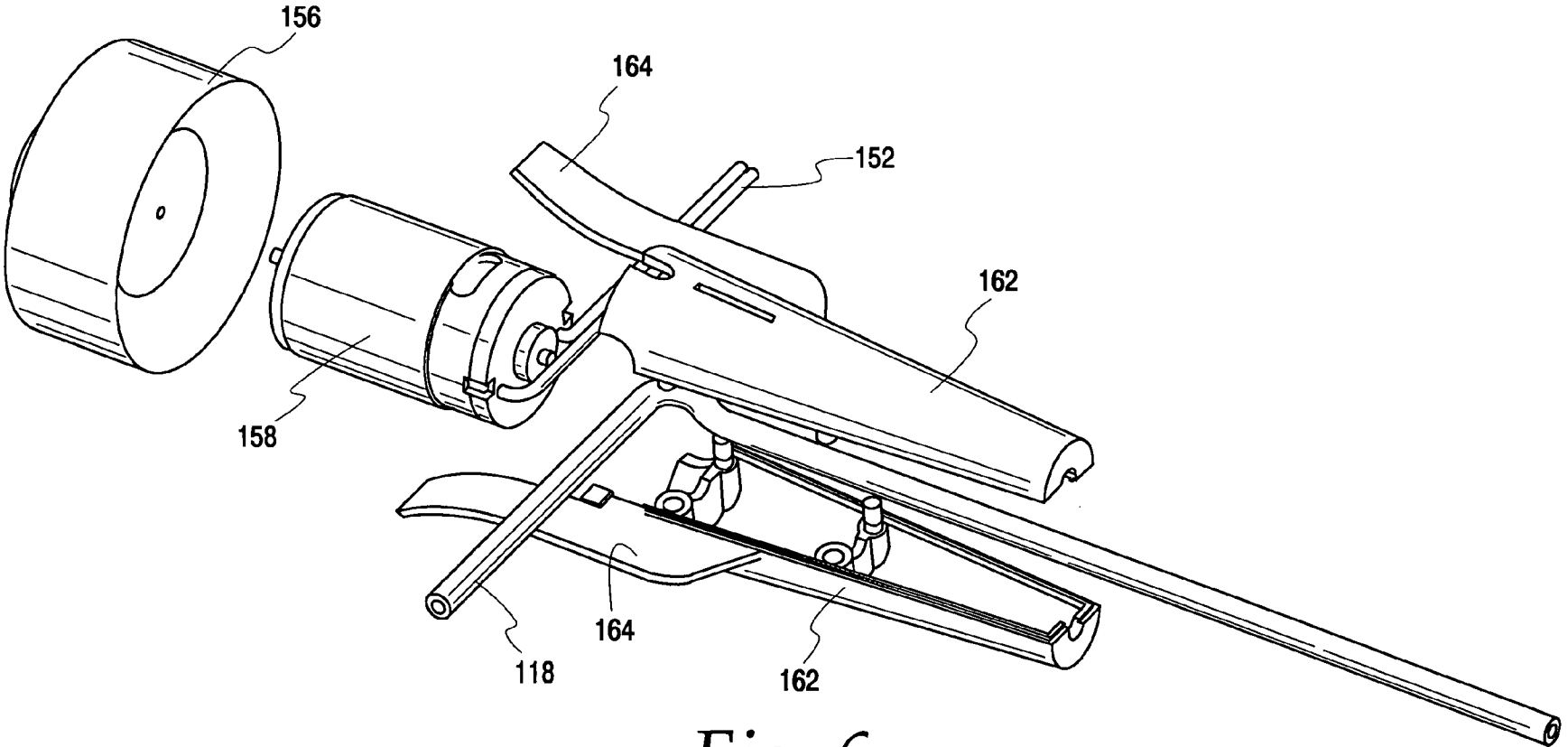
FIG. 6 is an exploded perspective view of the barrier dispensing nozzle shroud, also shown rotated about its axis 90° from its installed position.

The second nozzle for dispensing the barrier product is shown generally at 140 in FIGS. 5 and 6. The second nozzle is mounted in the housing in the cutouts 64 and extends fully across the width of the housing. It includes a wind tunnel 66 formed by two semi-cylindrical halves 142. Each wind tunnel half has a plurality of hooks 144 which engage catches 146 formed on the other half. Mounting tabs 148 are also provided for engagement with screws (not shown) which fix the wind tunnel to the housing. Slots 150 provide apertures for the barrier supply line 118 and for a motor wiring harness 152. A grating 154 is mounted near one entrance to the wind tunnel 66. The grating has a lattice of bars that permits air to enter the wind tunnel but prevent solid objects from entering. A fan 156 is mounted in the wind tunnel 66. The fan is driven by a fan motor 158. The fan motor mounts a fan shroud 160. The fan shroud is made of two shroud halves, each of which includes a body portion 162 and a wing 164 (FIG. 6). The body and wing direct air through the wind tunnel 66. The barrier supply line 118 extends through the interior of the fan shroud 160. The barrier supply line has a radial portion that extends through the aperture 150 in the wind tunnel to connect to the liquid pump. An axial portion of the barrier supply line 118 runs through the fan shroud 160 to a nozzle tube support member 166. The support member is clamped between the edges of the wind tunnel. The support member 166 mounts a barrier fluid emitter 168 that is in fluid communication with the end of the axial portion of the barrier supply line 118. The emitter 168 produces a fan-shaped spray pattern in a vertical orientation. The end of the wind tunnel 66 communicates with a cylindrical second nozzle shroud 16. The shroud is axially aligned with the wind tunnel. Shroud 16 is fixed to the housing by the knurled collar 20. The axis of the second nozzle is disposed parallel to the bottom and top walls of the housing. Thus, when the housing is in its normal orientation wherein the bottom wall is parallel to the ground, the second nozzle will dispense the barrier product in a generally horizontal direction. The combination of the air flow through the wind tunnel 66 and the liquid emitter 168 produces a barrier product spray having droplet sizes of about 80 to 200 microns in volume median diameter. This droplet size allows the barrier product droplets to penetrate a greater distance than the ULV spray and it also allows the barrier product to coat area foliage with a repellant layer that discourages mosquitoes from entering the protected zone.

Figure 7:
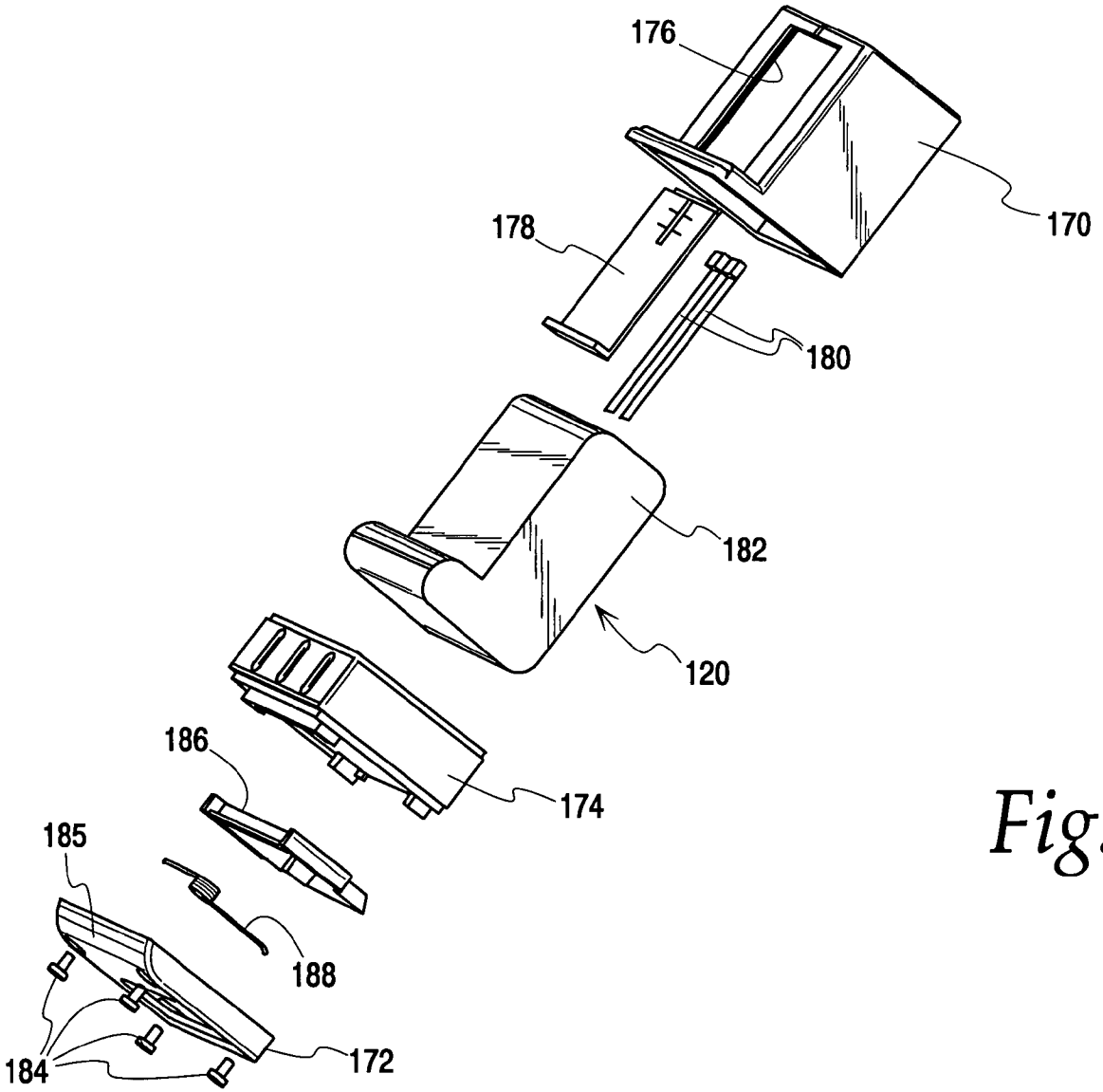
FIG. 7 is an exploded perspective view of the battery pack.
Figure 8:
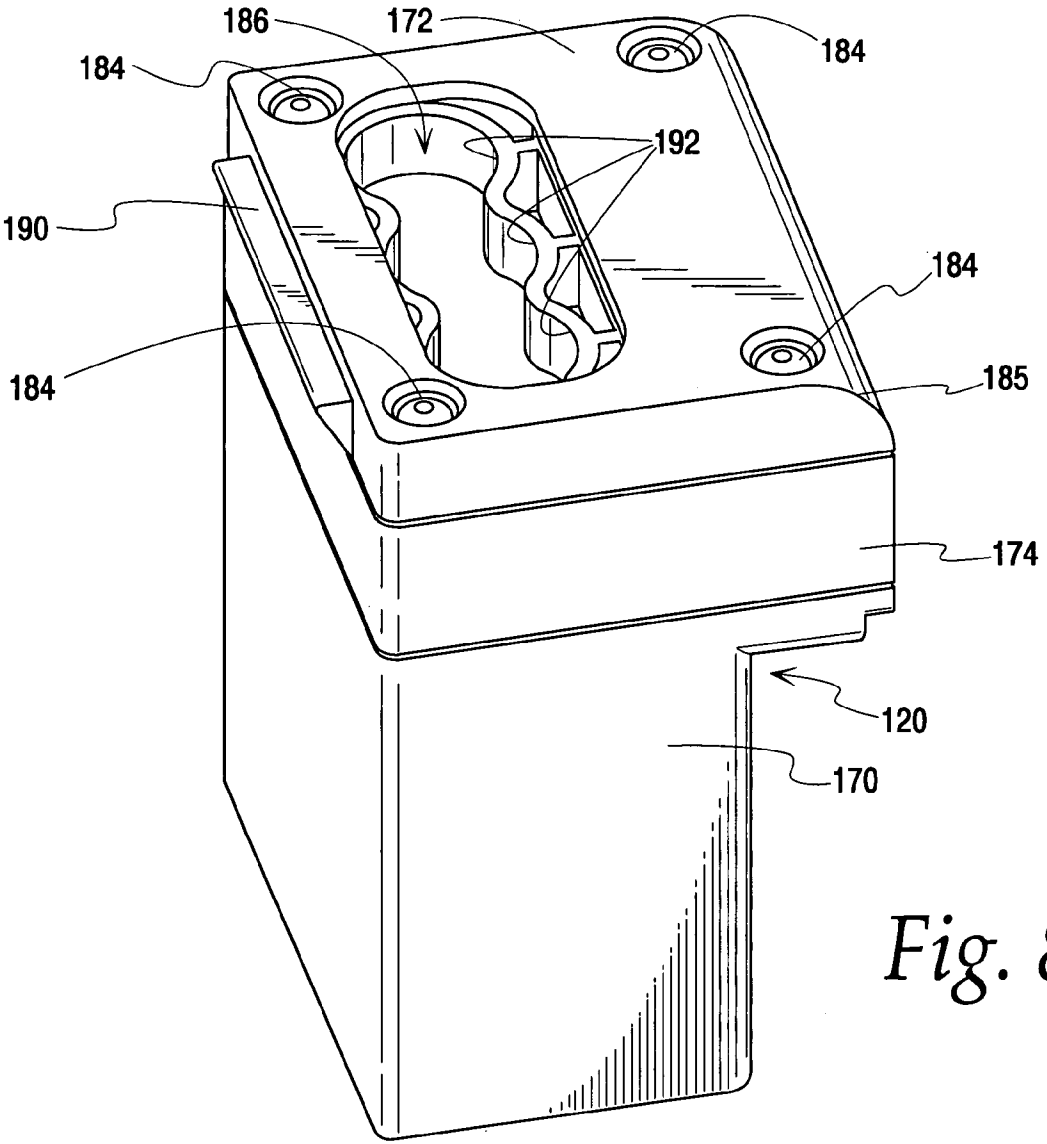
FIG. 8 is a perspective view of the underside of the battery pack, showing the latch.

The battery pack 120 is illustrated in FIGS. 7 and 8. It has a case including a top 170, a bottom 172, and a false bottom 174. The top 170 is closed on three sides and one end. The fourth, open side 176 of the top receives a contact support member 178. Battery contact strips 180 are attached to the support member 178. The contact strips provide electrical connection to a package of battery cells shown at 182. Most of the cell package fits into the top 170 of the case. The remainder fits into the false bottom 174. The false bottom is a four-sided structure with open ends. The bottom portion 172 is fastened to the false bottom 174 by screws 184. The bottom 172 is a tray having a curved edge 185 and openings on it lower surface and on one side edge. A latch 186 is slidably mounted in the bottom portion 172. A spring 188 urges the latch 186 outwardly of the bottom 172 but only a beveled edge 190 of the latch can fit through the side opening of the bottom portion. The remainder of the latch is retained in the bottom portion 172. When the beveled edge 190 protrudes from the bottom it is engageable with the catch 88 on the sprayer housing to retain the battery pack in the battery compartment 72. The latch 186 can also be retracted fully into the bottom portion 172 so as to release the battery pack 120 from the sprayer housing. The latch 186 includes a series of grooves 192 that are accessible to a user through the lower opening in the bottom portion. The user can place a thumb on the curved edge 185 and two or three fingers in the grooves 192 to enable the user to squeeze the latch and retract it for the purpose of releasing the battery pack from the sprayer housing. Installing a replacement battery pack simply requires pushing the battery pack into the compartment 72. The beveled edge of the latch will allow it to retract upon contact with the catch 88 during insertion. Once the latch clears the catch, the spring 188 will push the latch back into its extended position where it will engage the catch and hold the battery pack in the battery compartment.

FIG. 2 illustrates an auxiliary battery pack 194 resting in a charge receptacle 196 in the cradle 36. The cradle also includes a depression 198 for receiving the sprayer. The auxiliary battery pack 194 will be charged and ready to swap with a discharged battery in the sprayer. Obviously it is intended that the discharged pack will be placed in the charge receptacle 196 so it can be recharged. As mentioned above, when the sprayer is returned to the depression 198 in the cradle 36, the battery pack that is mounted in the sprayer will also be recharged. Thus, two fully charged battery packs should be available at the start of most uses of the sprayer. Two charged batteries will be sufficient to treat the yards of most homeowners.

The use and operation of the sprayer are as follows. With a fully charged battery pack and a full liquid reservoir cartridge, the user grasps the sprayer by the handle 28 and removes it from the cradle 36. The sprayer is transported to the area to be treated and, after assuring that conditions are safe for treating the area, the user actuates the control switch 30. This activates the microcontroller which first verifies that a non-empty liquid reservoir is present in the reservoir compartment 80 and that sufficient battery voltage is available to generate the required air and liquid flow rates and pressures. If so, the microcontroller activates the air pump motor 110 and the fan motor 158. Shortly thereafter the microcontroller activates the liquid pump which sends the knockdown liquid to the emitter 132 and the barrier liquid to the emitter 168. The user then traverses the perimeter of the area to be treated. If the microcontroller senses that the battery voltage has fallen below a level needed to assure proper droplet formation it will shut down the liquid pump and then the air motors. The user can then change the battery pack as described above to continue the treatment process. Similarly, if the microcontroller senses that the liquid reservoirs are empty, it will shut down the liquid pump and then the air motors. The user can then change the liquid reservoir cartridge as described above. When the entire area to be treated has been treated the user releases the control switch. The liquid pump shuts off, followed by the air motors. The user returns the sprayer and auxiliary battery pack to the charging cradle so the batteries will recharge and be ready for the next application.

Figure 9:
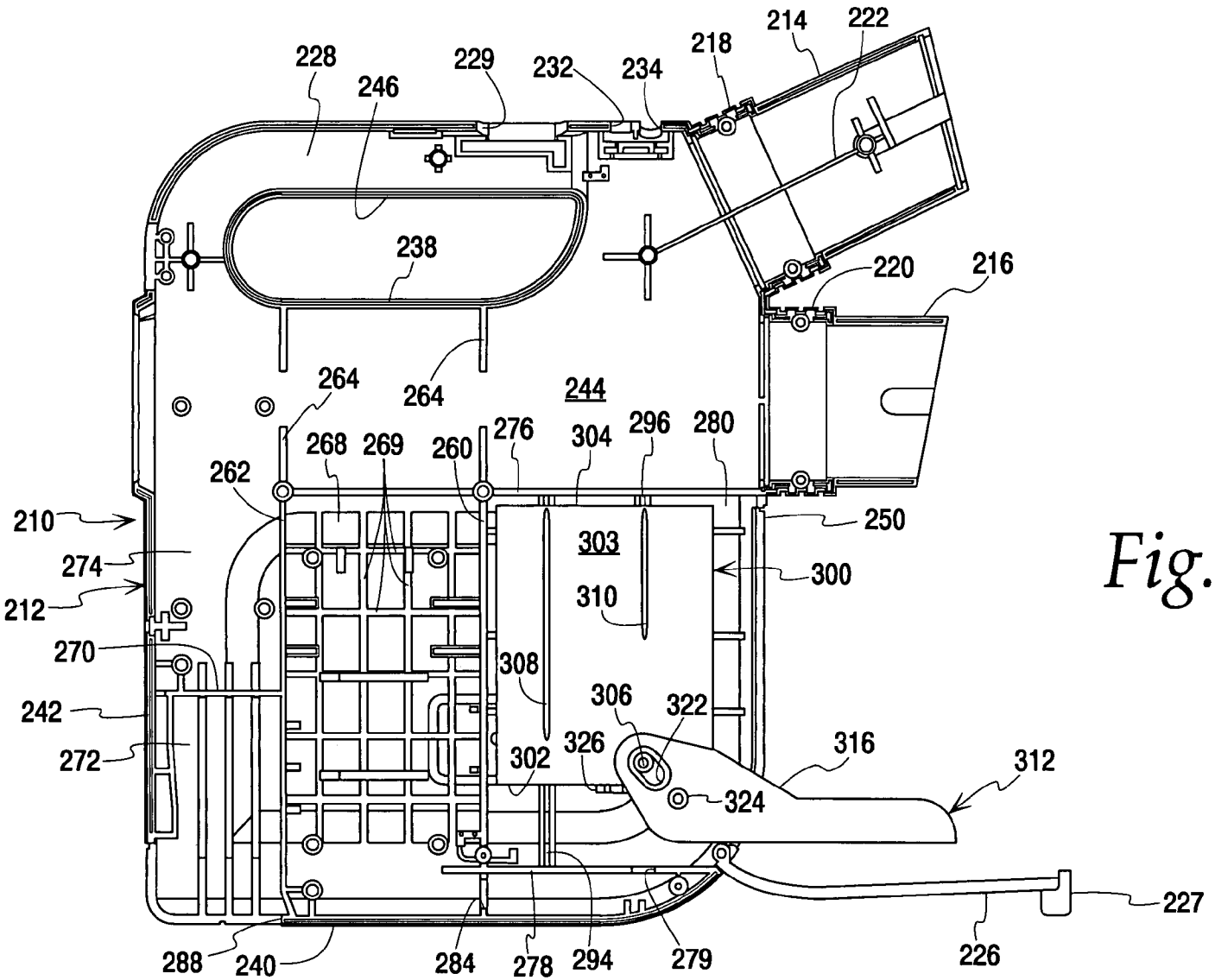
FIG. 9 is a side elevation view of the interior of a housing case half, showing just the reservoir cartridge assembly in its installed and open position.

An alternate embodiment of the sprayer is shown at 210 in FIG. 9. It is generally similar to the sprayer 10; differences will be noted below. The sprayer includes a housing 212. As before the housing is vertically split into two, case-like halves. In this embodiment the shrouds 214, 216 are integrally formed with the housing cases. The circular collars 218, 220 surrounding the shrouds in this case are ornamental. The liquid emitter mounting bracket 222 of the first nozzle is visible within the shroud 214. The liquid emitters themselves are as described above. Beneath the second nozzle shroud 216 there is a door 226 that provides access to a liquid reservoir compartment 280. The door has a latch 227. Unlike the previous embodiment, this door does not function as a lever for actuating a reservoir support tray; there is a separate lever which will be described in detail below. A handle 228 has an opening 229 on top to receive a control switch (not shown). In front of the opening are windows 232, 234 for operational indicators such as an LED or LCD display.

The housing half 212 includes a top wall 238, a bottom wall 240, a rear wall 242 and a side wall 244. The top wall 238 curves upwardly toward the front of the housing so that together with the handle 228 it defines an opening 246 that receives a user's hand. The continuation of the top wall 238 slopes downwardly at an angled portion surrounding shroud 214 to meet with the front wall 250. The door 226 forms much of the front wall.

The housing 212 has internal walls or partitions similar to those of the first embodiment. Thus, there are front and rear vertical partitions 260, 262 each with a curving cradle 264 for supporting the wind tunnel. The pump compartment is shown at 268. It includes a plurality of criss-crossing reinforcing ribs 269. Divider wall 270 defines the battery compartment 272 and a control circuit compartment 274. Top and bottom horizontal walls 276, 278 join the front vertical partition 260 to define the liquid reservoir compartment 280. The bottom wall 278 has a slot 279 that receives a connector support beam which will be described in detail below. Passage 284 provides access for the fluid supply lines. At the lower left corner of the bottom wall 240 is a catch 288. The catch is engageable with a latch on the battery pack to retain the battery pack in the battery compartment 272. The internal components such as the pumps, motors, tubing, wind tunnel and electrical circuits and controls are as described above.

Figure 10:
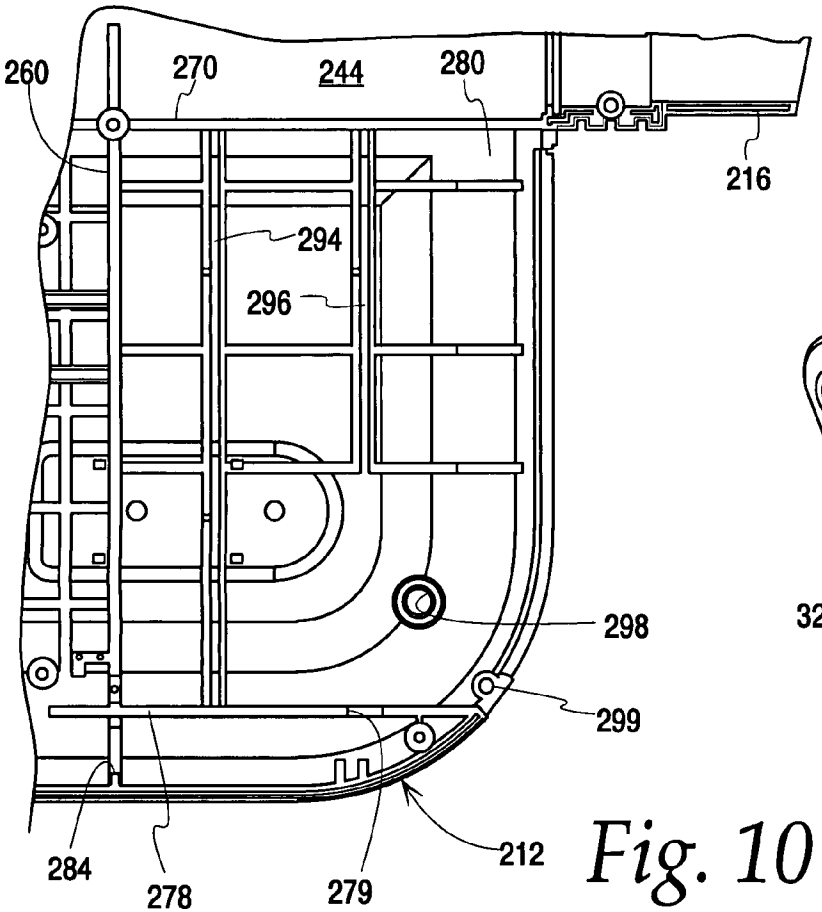
FIG. 10 is a side elevation view of the liquid reservoir compartment of the housing with the reservoir cartridge assembly removed.

As best seen in FIG. 10, the reservoir compartment 280 has a pair of vertical channels or tracks built into the side wall 244. There is a long channel 294 and a short channel 296. The side wall also contains a circular boss 298 which pivotally mounts a lever as will be described below. Pivots 299 for the door 226 are also formed at the front wall 250. It will also be noted that there are a plurality of pegs, sockets and screw receptacles for aligning and fastening the two housing halves together.

Returning to FIG. 9, a cartridge bay 300, similar to tray 100, is mounted for reciprocating movement in the reservoir compartment 280. The cartridge bay is a four-sided box having a floor 302, two side walls 303 and a top wall 304. These surfaces define a cavity 305 (FIG. 12) which removably receives a reservoir cartridge 290. A docking station 326 is formed on the underside of the floor. Details of the docking station are set forth below. A cam follower in the form of a stubshaft 306 is attached to each side wall 303. The side walls also have long and short rails 308, 310 affixed thereto. These rails fit into the long and short channels 294, 296, respectively. The rails and channels guide the cartridge bay 300 in a sliding, reciprocating motion in the compartment 280.

Figure 11:
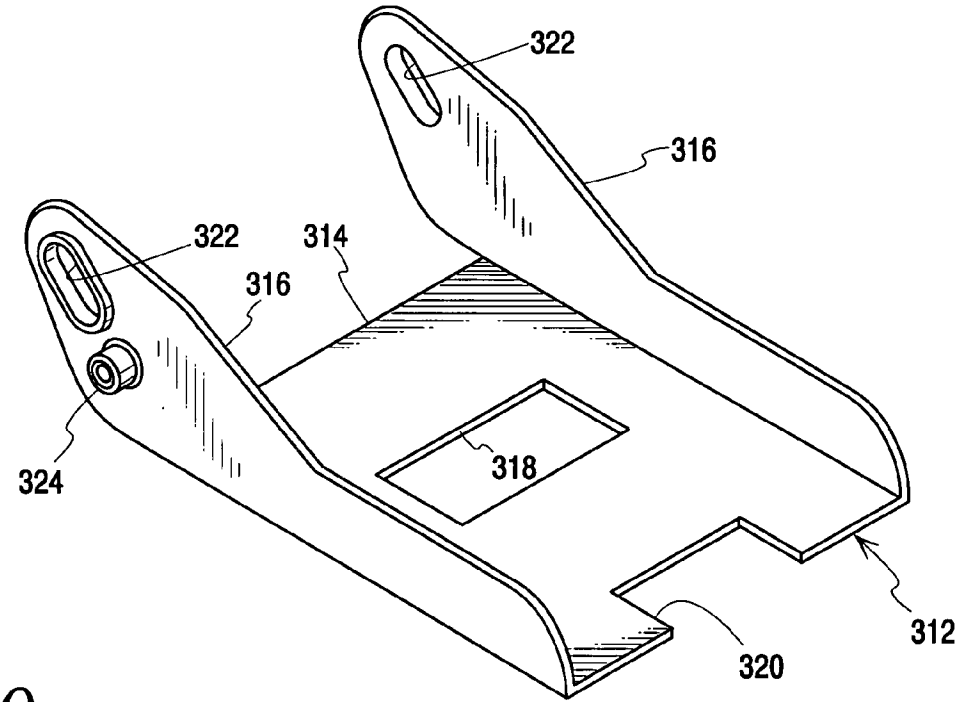
FIG. 11 is a perspective view of the lever.

That motion is effected by a lever 312 shown in FIGS. 9 and 11. The lever has a central panel 314 bounded by a pair of wings 316. The wings are separated a distance that allows them to just fit around the outer surfaces of the bay side walls 303. The central panel 314 has a window 318 to provide visual access to the interior of the cartridge bay 300. A cutout 320 at the top of the panel provides convenient finger access to manipulate the lever. Each wing 316 has a cam in the form of an elongated slot 322 formed in it. The slots 322 receive a stubshaft 306 of the cartridge bay 300, as shown in FIG. 9. Short pivot shafts 324 extend from the outer surfaces of the wings. The pivot shafts fit into the bosses 298 in the housing to mount the lever 312 for pivoting motion.

Figure 12:
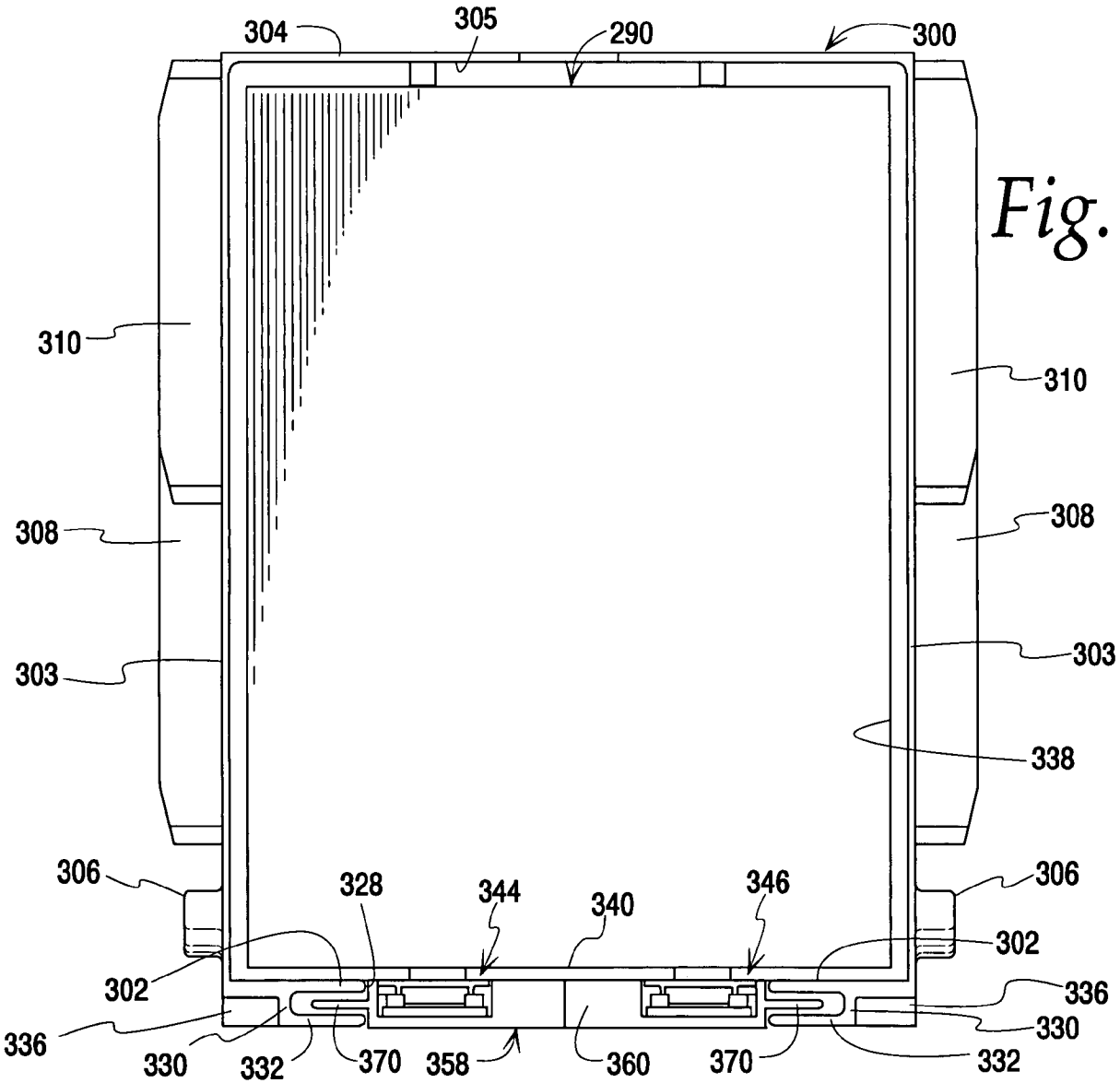
FIG. 12 is a front elevation view of the cartridge bay and an installed reservoir cartridge assembly, on an enlarged scale compared to FIG. 10.
Figure 13:
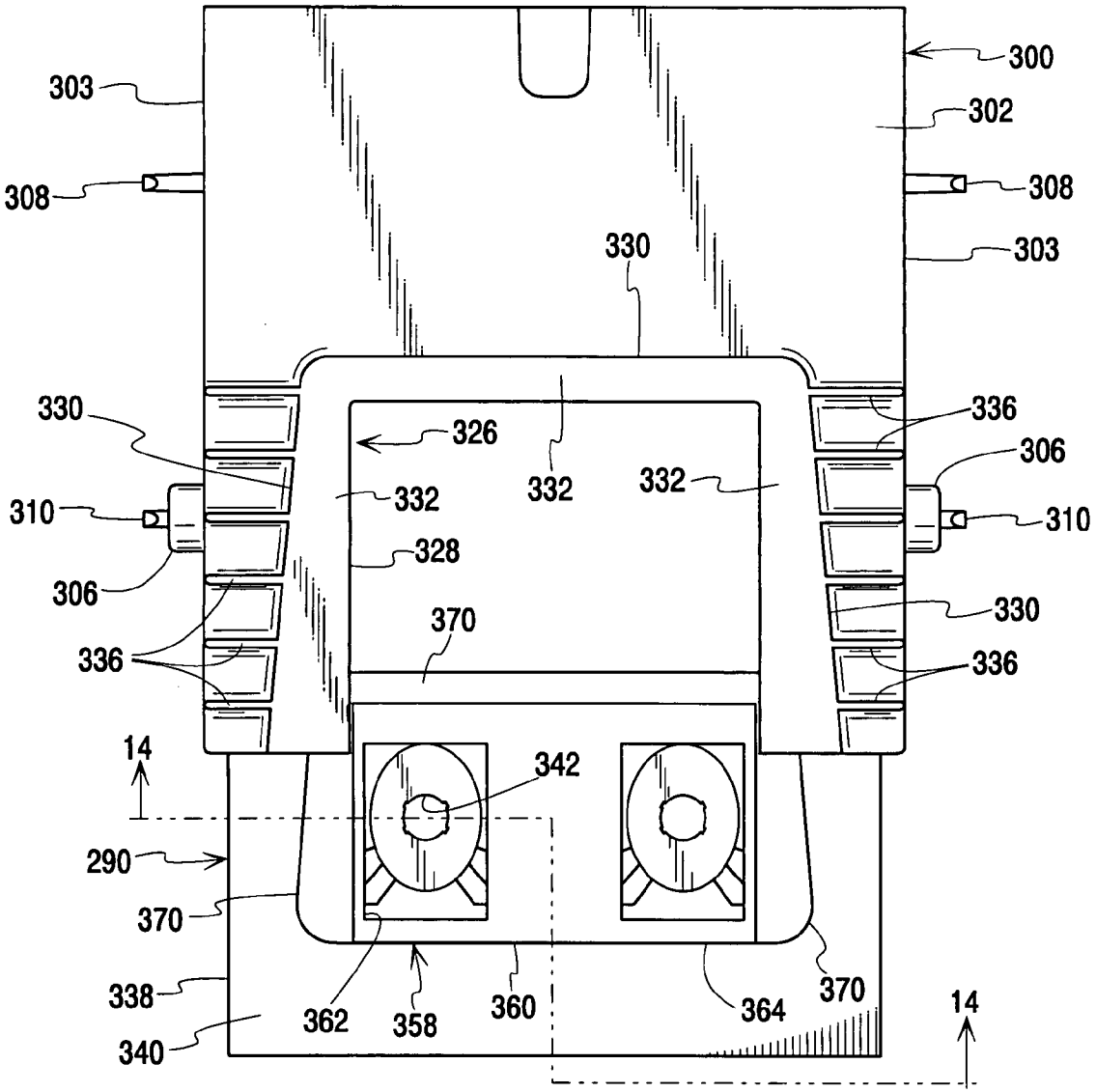
FIG. 13 is a bottom plan view of the cartridge bay with a reservoir cartridge assembly partially installed therein.
Figure 14:
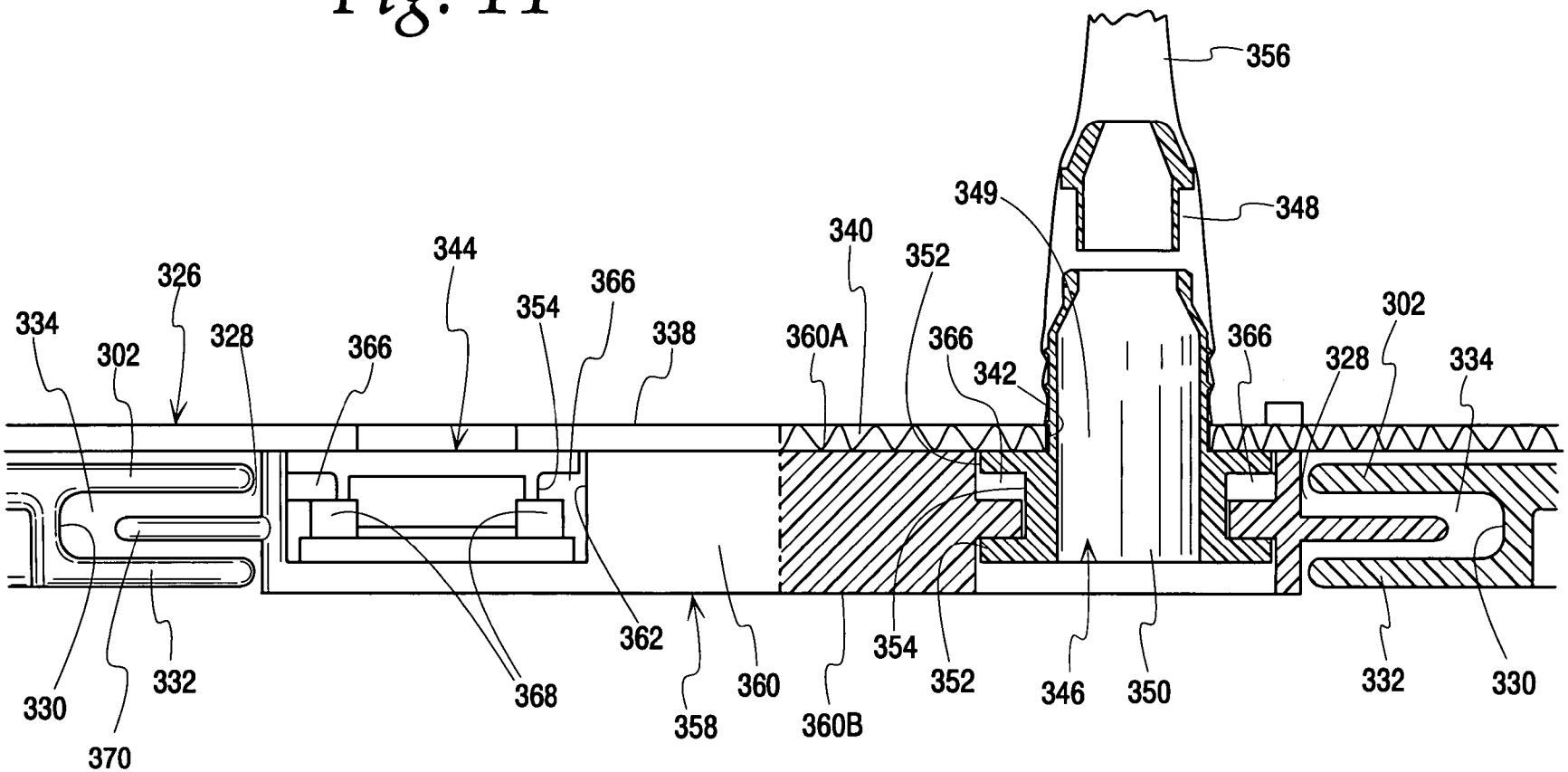
FIG. 14 is a section taken along line 14-14 of FIG. 13, on an enlarged scale.

Turning now to FIGS. 12-14, further details of the cartridge bay 300 and the reservoir cartridge 290 are shown. The bay includes a docking station indicated generally at 326. The docking station is formed by a cutout 328 at the front edge of the floor 302. The perimeter of the cutout is surrounded by a downwardly extending boundary wall 330. A web 332 joins the boundary wall, spaced from and parallel to the floor 302. The inside edge of the web aligns with the cutout 328. Together the web, boundary wall and floor define a channel 334 (FIG. 14). The boundary wall and web are preferably strengthened by a plurality of ribs 336.

The reservoir cartridge 290 includes a box 338 having an end panel 340 with a pair of oval-shaped openings 342 therethrough. The box is preferably made of a disposable material such as cardboard. First and second cartridge components 344, 346 of the fluid connectors extend through the openings 342. Each cartridge component includes an upstanding receptacle 348 (FIG. 14) disposed inside the box, a neck 349 that extends through the opening 342, and a head 350 located outside the box. The head has a pair of spaced oval rims 352 on either side of a sleeve 354. Each receptacle 348 is attached to a liquid chamber, an empty one of which is shown schematically at 356. The liquid chamber is preferably a plastic bag which is sealed to the receptacle in a liquid-tight manner. The receptacle, neck and head form a female connector having a central passage through these pieces and a valve (not shown) in the passage. The valve provides fluid communication through the passage when the cartridge component is joined to a housing component of a fluid connector pair. The valve acts as a plug that prevents fluid flow when the cartridge component is separated from the housing component.

On the exterior of the box 338 the heads 350 of the cartridge components 346, 348 are entrapped in a guide strip 358. The guide strip has a collar 360 having first and second pockets 362, 364 for fixably receiving therein the head 350 of a cartridge component of a fluid connector pair. The pockets are located in the collar so as to define a fixed relation to one another. Each pocket includes a locator 366 that fits between the rims 352 and engages the sleeve 354. A pair of fingers 368 also fit between the rims. The fingers flex to permit the head 350 to be inserted radially into the pocket but they then engage the sleeve 354 in a manner that prevents the head from releasing from the pocket. The guide strip 358 further has a flange 370 surrounding the collar 360 on three sides. The collar has top and bottom edges 360A, 360B (FIG. 14), with the flange 370 being spaced from the top edge such that when the top edge of the collar is adjacent to the end panel 340 of the box 338 the flange 370 is spaced from the end panel.

Figure 15:
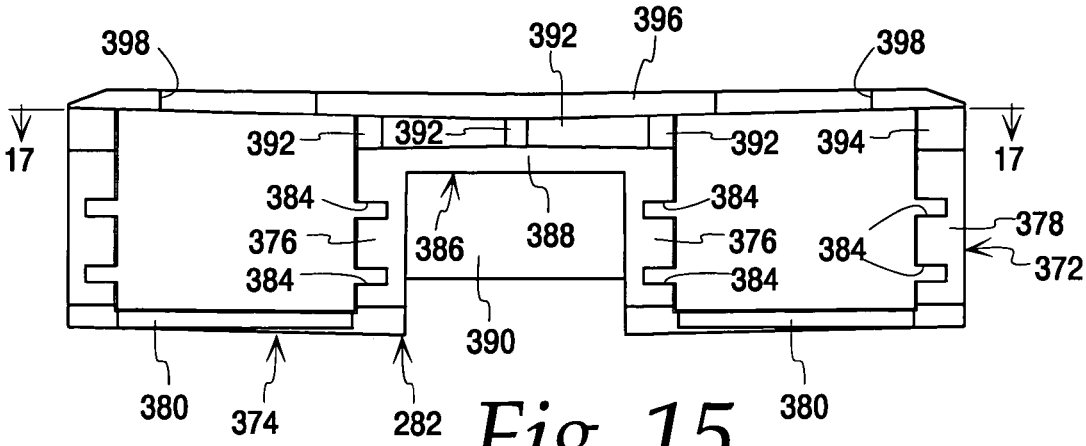
FIG. 15 is a rear elevation view of the support beam.
Figure 16:
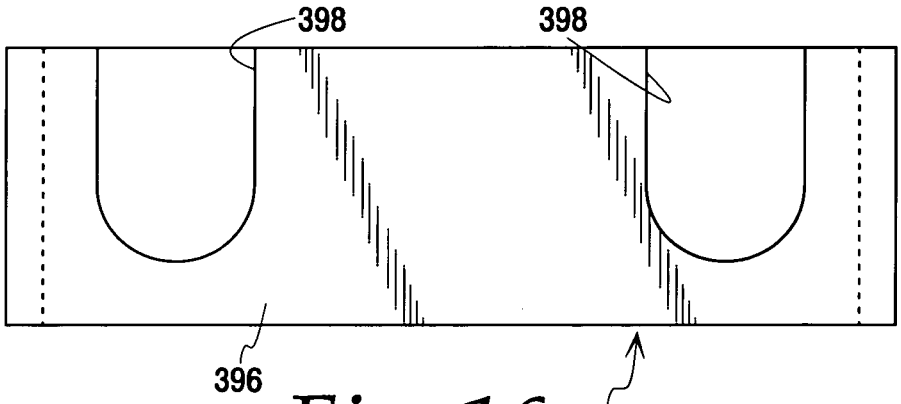
FIG. 16 is a top plan view of the support beam.
Figure 17:
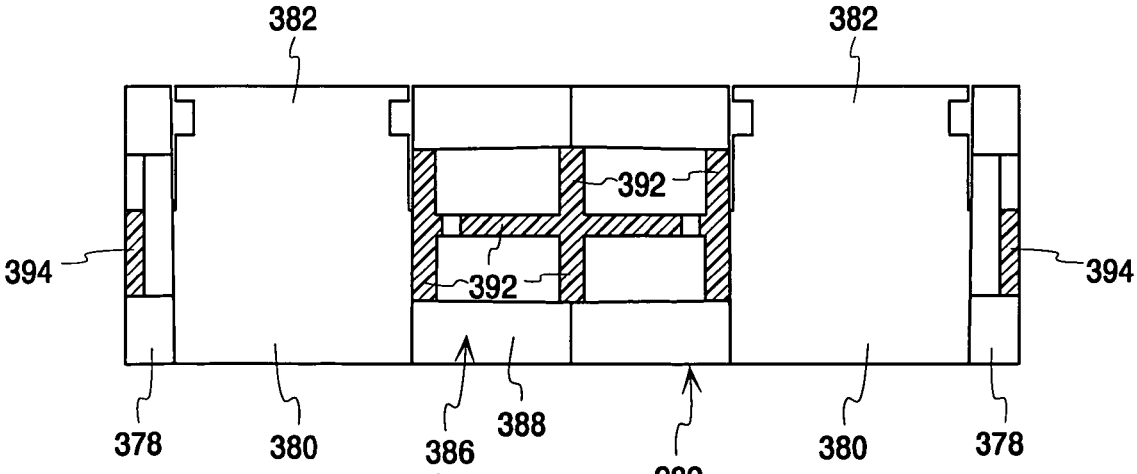
FIG. 17 is a section taken along line 17-17 of FIG. 15.

Details of the support beam 282 are shown in FIGS. 15-17. The support beam includes first and second compartments 372, 374 each arranged to receive a housing component of a fluid connector pair therein. That is, a male connector 292 (FIG. 18) fits into each compartment. Each compartment is defined by inside and outside walls 376, 378 joined by a bottom wall. The bottom wall has a fixed portion 380 (FIG. 17) connected to the inside and outside walls and a flexible flap 382 attached to the fixed portion 380 and spaced from the inside and outside walls 376, 378. The flap provides a lock that retains a male connector in the compartment. It rides up a ramp on the underside of the connector and then snaps in place to engage the connector and prevent it from coming out of the compartment. The inner surfaces of the inside and outside walls have a pair of slots 384. The inside walls 376 of the compartments are connected to a base 386. In this case the base includes a horizontal plate 388 and a vertical gusset 390. The base 386 secures the compartments in fixed relation to one another. This relation is the same as that defined by the pockets 362, 364 in the collar 360 of the guide strip 358. That is, the vertical axes of the compartments 372, 374 are spaced the same as the vertical axes through the guide strip pockets 362, 364.

The support beam 282 further includes a plurality of interior spacers 392 attached to the plate 388 and exterior spacers 394 attached to the top of the outside walls 378 of the compartments. A roof 396 is affixed to the spacers 392 and 394. The 396 roof overlies the base 386 and compartments 372, 374 and has U-shaped cutouts 398 (FIG. 16) aligned with the vertical axes of the compartments 372, 374. The cutouts permit the housing components of the fluid connectors to extend through the roof. The spacers allow the roof and base to define a slot between the underside of the roof and the top surface of the compartments. The thickness of this slot is slightly greater than the thickness of the sprayer housing's bottom horizontal wall 278 such that the wall 278 fits snugly between the roof and the base. Also, the depth of the spacers is less than the width of the slot 279 formed in the bottom wall 278 such that the spacers fit into the slot. This fixes the support beam to the housing. Since the location of the slot 279 is molded into the housing, and the support beam spacers fit into the slot (actually two slots of the two housing halves), and the compartments are fixed with respect to the base and spacers, it follows that the fluid connector components within the compartments will always be in a known, fixed location.

Figure 18:
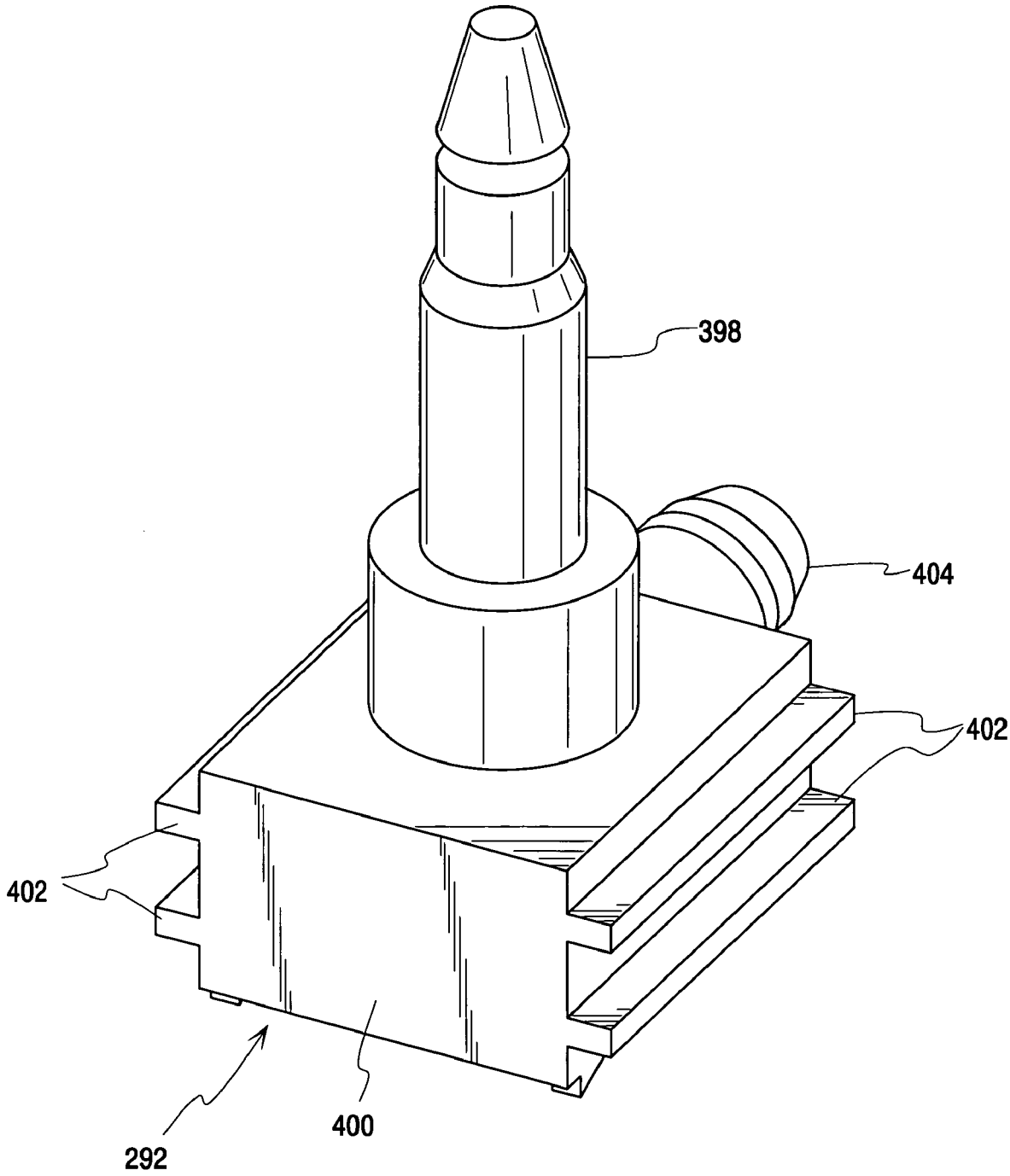
FIG. 18 is a perspective view of the housing component of a fluid connector pair.

One of the housing components of the fluid connectors is shown at 292 in FIG. 18. This is a male connector which, like the female connectors 344, 346, has a fluid passage through it and a valve in the passage. The valve permits fluid flow through the passage when the housing component is joined to a cartridge component of a fluid connector pair. The valve acts as a plug that prevents fluid flow when the housing component is separated from the cartridge component. The connector has a block 400 with rails 402 on the exterior sides. The block and rails are sized such that the block fits snugly between the inner and outer walls of the compartments 372, 374 with the rails 402 engaging the slots 384. A nipple 404 provides a connecting point for one of the supply lines 94A, 94B. A post 406 extends upwardly from the block 400. When the connector is installed in the support beam 282 the post extends through the U-shaped slot 398.

The use, operation and function of this embodiment are as follows. A new, full reservoir cartridge 290 is installed by releasing the latch 227 on door 226 and pivoting the door to the open, horizontal position of FIG. 9. This exposes the lever 312 which will be in a closed, vertical position. The user pivots the lever 312 downwardly, i.e., clockwise as seen in FIG. 9, causing the wings to pivot about shafts 324. This in turn causes the cams 316 to pivot, and the followers 306 of the cartridge bay 300 will move with them as well. Since the rails 308, 310 and channels 294, 296 constrain the cartridge bay to move in a straight line, the result will be an upward vertical movement of the bay. The followers 306 while moving in a straight line with the bay, will slide within the cams 316.

With the cartridge bay raised, the heads and receptacles of the female connectors 344, 346 will disengage the male connectors' posts 406. The floor 302 of the bay and the bottom edge 360B of the collar will clear the top of the posts. This frees a spent cartridge for removal by sliding it out of the cavity of the bay. The guide strip 358 will slide out of the docking station 326 with the box 338. A new, full cartridge is installed by sliding it into the bay. The end panel 340 of the box will engage the upper surface of the bay floor 302. The flange 370 of the guide strip will enter the channel 334 of the docking station, with the flange slipping underneath the bay floor. The box is inserted until the guide strip is fully engaged with the docking station, i.e., the collar hits the end of the cutout 328. Since the pockets of the guide strip positively locates the heads of the female connectors, and the docking station locates the guide strip relative to the cartridge bay, and the bay rails and housing channels define the scope of the bay's motion, it follows that the receptacles 348 of the female connectors will always be in alignment with the posts 406 of the male connectors. With such alignment assured, the user need only rotate the lever back to its closed, vertical position. Doing so causes the cams 316 to pull the cartridge bay down, with the receptacles 348 fitting down onto the posts 406, thereby opening the fluid flow paths from the liquid chambers 356 to the pumps. Finally, the user closes the door 226 and the sprayer is ready for use.

While the preferred form of the invention has been shown and described herein, it should be realized that there may be many modifications, substitutions and alterations thereto. For example, instead of using a single liquid pump with dual heads, separate pumps could be provided, one for each product. Alternately, the pump could be replaced entirely by one or more aerosol pressure cans. If aerosol cans are used, they would be a replacement item just like the liquid reservoir cartridge. Also, while various components of the sprayer are referred to as being in the housing, it will be understood that this is meant in a general sense that the components are connected, attached or mounted on, in or to the housing. In other words, portions of the components may protrude outside of a boundary wall of the housing and still be considered in the housing. A further alternate construction may include a separate lever inside the door 26. Thus, instead of the door actuating the reservoir cam 106, a lever just inside the door would be connected to the cam to actuate it. Also, while a hand-held sprayer has been shown and described, other arrangements are possible that would still allow the sprayer to be portable. For example, the housing might have wheels incorporated therein or the housing could be mounted on a ground-engaging cart. The support beam 82 is shown fixed to the housing but it could be made to be movable relative to the reservoir cartridge. The cartridge bay is shown as moving in a straight line but it could be otherwise, e.g., it could have an arcuate path or some combination of arcuate and straight movement.

We claim:

1. A portable sprayer, comprising:

a housing having first and second nozzles;

a reservoir cartridge removably installed in the housing and defining first and second liquid chambers;

at least one pump mounted in the housing and in fluid communication with the nozzles;

first and second pairs of fluid connectors, each pair including a housing component mounted in the housing in fluid communication with the pump and a cartridge component mounted to the reservoir cartridge in fluid communication with one of the liquid chambers, said components being relatively movable into and out of engagement with one another such that when joined the components define a fluid flow path therethrough and when separated the components define plugs which prevent fluid flow through the component;

a support beam connected to the housing components of the connector pairs and mounting said housing components relative to one another in a fixed relation; and a guide strip connected to the cartridge components of the connector pairs and mounting said cartridge components relative to one another in the same fixed relation as the support beam mounts the housing components.

2. The sprayer of claim 1 further comprising a cartridge bay mounted in the housing and defining a cavity in which a reservoir cartridge may be removably installed.

3. The sprayer of claim 2 further comprising a docking station formed in the cartridge bay for releasably receiving and locating the guide strip, the docking station being positioned relative to the housing components of the connector pairs to ensure alignment between the components of the respective pairs.

4. The sprayer of claim 2 wherein the cartridge bay is reciprocally movable and the guide beam is fixed.

5. The sprayer of claim 4 further comprising guide channels formed in the housing and rails formed on the cartridge bay, the rails being disposed in the guide channels.

6. The sprayer of claim 4 further comprising a lever pivotally attached to the housing, and a cam associated with the lever and engageable with the cartridge bay to cause the cartridge bay to reciprocate upon pivotal movement of the lever.

7. The sprayer of claim 6 wherein the cam comprises at least one slot formed in the lever, and further comprising at least one cam follower attached to the cartridge bay and extending through said slot.

8. The sprayer of claim 1 wherein the support beam is connected to the housing.

9. The sprayer of claim 1 wherein one of the housing and cartridge components comprises a male connector and the other comprises a female connector.

10. The sprayer of claim 9 wherein the housing components are male and the cartridge components are female.

11. The sprayer of claim 1 wherein the guide strip comprises:

a collar having first and second pockets for fixably receiving therein a cartridge component of a fluid connector pair, the pockets being located to define said fixed relation.

12. The sprayer of claim 11 further comprising:

a cartridge bay mounted in the housing and defining a cavity in which a reservoir cartridge may be removably installed;

a docking station formed in the cartridge bay for releasably receiving and locating the guide strip, the docking station being positioned relative to the housing components of the connector pairs to ensure alignment between the components of the respective pairs.

13. The sprayer of claim 12 wherein the cartridge bay further comprises a floor and the docking station comprises a cutout adjoining one edge of the floor, the cutout being sized to receive the collar of the guide.

14. The sprayer of claim 13 wherein the guide strip further comprises a flange surrounding at least a portion of the collar, the collar having top and bottom edges with the flange being spaced from the top edge such that when the top edge of the collar is adjacent an exterior wall of a cartridge the flange is spaced from said exterior wall.

15. The sprayer of claim 14 wherein the docking station further comprises a boundary wall attached to the floor and surrounding the perimeter of the cutout, and a web attached to the boundary wall and extending parallel to the floor to define a channel for removably receiving the flange, with the flange being disposed between the floor and the web.

16. A portable sprayer, comprising:

a housing having at least one nozzle, the nozzle including an emitter for releasing an ultra low volume spray from the nozzle;

a reservoir cartridge removably installed in the housing and defining a liquid chamber;

at least one liquid pump mounted in the housing and in fluid communication with the emitter and the liquid chamber, the liquid pump delivering liquid to the emitter at the rate of about 35 to 40 milliliters per minute;

a liquid pump motor connected to the liquid pump in driving relation therewith;

an air pump mounted in the housing and in fluid communication with the emitter, the air pump delivering air to the emitter at a rate of about 6 liters per minutes at pressure of about 7 to 8 pounds per square inch;

an air pump motor connected to the air pump in driving relation therewith; and a battery mounted in the housing and electrically connected to the air pump motor and the liquid pump motor for supplying power thereto.

17. A portable sprayer, comprising:

a housing having at least one nozzle;

a cartridge bay slidably mounted in the housing and defining a cavity therein;

a lever pivotally attached to the housing, and a cam associated with the lever and engageable with the cartridge bay to cause the cartridge bay to reciprocate upon pivotal movement of the lever;

a reservoir cartridge removably installed in the cavity of the cartridge bay, the cartridge defining at least one liquid chamber;

at least one pump mounted in the housing and in fluid communication with the nozzle and the liquid chamber;

at least one pair of fluid connectors, the pair including a housing component mounted in the housing in fluid communication with the pump and a cartridge component mounted to the cartridge in fluid communication with the liquid chamber, said components being relatively movable into and out of engagement with one another such that when joined the components define a fluid flow path therethrough and when separated the components define plugs which prevent fluid flow through the component.

18. The sprayer of claim 17 further comprising a docking station formed in the cartridge bay for releasably receiving and locating the cartridge component.

19. The sprayer of claim 17 wherein the connector pair's housing component is fixed to the housing.

20. The sprayer of claim 17 wherein the cam comprises at least one slot formed in the lever, and further comprising at least one cam follower attached to the cartridge bay and extending through said slot.

21. The sprayer of claim 17 further comprising guide channels formed in the housing and, rails formed on the cartridge bay, the rails being disposed in the guide channels.

22. A portable sprayer, comprising:

a housing having first and second nozzles;

a reservoir cartridge removably installed in the housing and defining first and second liquid chambers;

at least one pump mounted in the housing and in fluid communication with the nozzles;

first and second pairs of fluid connectors, each pair including a housing component mounted in the housing in fluid communication with the pump and a cartridge component mounted to the cartridge in fluid communication with one of the liquid chambers, said components being relatively movable into and out of engagement with one another such that when joined the components define a fluid flow path therethrough and when separated the components define plugs which prevent fluid flow through the component; and a support beam including first and second compartments each arranged to receive a housing component of a fluid connector pair therein, and a base attached to each of the compartments to secure them in fixed relation to one another.

23. The sprayer of claim 22 wherein the support beam further comprises a plurality of spacers attached to the base and a roof overlying at least the base and supported on the spacers.

24. The sprayer of claim 23 wherein the housing further comprises a bottom horizontal wall having a thickness substantially equal to the height of the spacers such that the wall fits between the roof and the base.

25. The sprayer of claim 24 wherein the bottom horizontal wall has a slot formed therein and the depth of the spacers is such that the spacers fit into the slot.

26. The sprayer of claim 23 wherein the roof overlies at least a portion of each compartment and has cutouts formed therein which permit the housing components of the fluid connectors to extend through the roof.

27. The sprayer of claim 22 wherein each compartment is defined by inside and outside walls joined by a bottom wall, the inside walls being attached to the base.

28. The sprayer of claim 27 wherein the bottom wall a fixed portion connected to the inside and outside walls and a flexible flap attached to the fixed portion and spaced from the inside and outside walls.

29. The sprayer of claim 28 wherein the support beam further comprises a plurality of interior spacers attached to the base and an exterior spacer attached to each outside wall and a roof overlying the base and compartments, the roof being supported on the spacers.

* * * * *